US005472149A

United States Patent [19]

Bosch

[11] Patent Number: 5,472,149

[45] Date of Patent: Dec. 5, 1995

[54] COUPLING AND SUPPORT DEVICE FOR A TUBE

[75] Inventor: Luis B. Bosch, Sao Paulo, Brazil

[73] Assignee: Texplast Acessorios Texteis LTDA, Sao Paulo, Brazil

[21] Appl. No.: 160,658

[22] Filed: Dec. 2, 1993

[30] Foreign Application Priority Data

Dec. 2, 1992 [BR] Brazil ..... 9204923

[51] Int. Cl.[6] ..... D03J 5/08

[52] U.S. Cl. ..... 242/130.2; 242/571.3; 242/573

[58] Field of Search ..... 242/130.2, 129.7, 242/136, 571.3, 572, 573, 573.9

[56] References Cited

U.S. PATENT DOCUMENTS

| | | | |
|---|---|---|---|
| 2,712,909 | 7/1955 | Tabor | 242/130.2 |
| 2,836,376 | 5/1958 | Winslow | 242/130.2 |
| 2,873,930 | 2/1959 | Brunner | 242/130.2 |
| 3,170,654 | 2/1965 | Winslow | 242/130.2 |
| 3,266,750 | 8/1966 | Whitehead, Sr. et al. | 242/130.2 |
| 4,015,797 | 4/1977 | Tsukumo | 242/130.2 |
| 4,111,381 | 9/1978 | Kitamura | 242/130.2 |
| 4,919,363 | 4/1990 | Kitamura | 242/130.2 |

FOREIGN PATENT DOCUMENTS

| | | | |
|---|---|---|---|
| 561186 | 8/1958 | Canada | 242/130.2 |

*Primary Examiner*—Daniel P. Stodola
*Assistant Examiner*—Michael R. Mansen
*Attorney, Agent, or Firm*—Jacobson, Price, Holman & Stern

[57] ABSTRACT

A coupling and support device for a tube used during an unrolling and coiling process for fiber strands. The device includes a cylindric body containing, on its upper part, a screwed peg, rotatively mounted by a bearing, a lamellar spring attached by a rivet, windows and a vertical groove located on a surface, at the lower end of the body, where there are four internal rabbets and four openings, equally spaced, for retraction and expansion of the four tongues. An activator is mounted in a sliding way in the interior of the body and has upper rims, a rotating selector with a longitudinal salience which is attached to the activator by a peg, at the lower end of the activator, where there are four grooves, equally spaced, for the housing of the tongues, kept in their correct position by a ring-shaped spring mounted in a cylindric depression. The retraction and the expansion of the tongues are originated by the angular movement of the selector.

3 Claims, 3 Drawing Sheets

COUPLING AND SUPPORT DEVICE FOR A TUBE

FIELD OF THE INVENTION

The current invention refers to a coupling and support device for a tube used during an unrolling and coiling process for fiber strands.

BACKGROUND OF THE INVENTION

Nowadays, known techniques include devices containing two retractable radial tongues which are extended through the longitudinal movement of a cursor, which attaches the two tongues to the tubes along their internal diameter. In spite of the fact that these devices are widely used, such devices inconveniently attach the tube on only two sides, allowing for imbalance and causing defects in the wire due to changes in the tension of the strands, besides making replacement of the tubes difficult in modern automated machines.

SUMMARY OF THE INVENTION

To solve such inconveniences, the invention refers to a coupling and support device with at least four retractable radial tongues. The tongues are fit into the internal diameter of the tube to give the tube more stability.

These and other objects of the invention, as well as many of the intended advantages thereof, will become more readily apparent when reference is made to the following description taken in conjunction with the accompanying drawings.

BRIEF DESCRIPTION OF THE DRAWINGS

The invention will be described below, based on the annexed figures. The figures represent a concrete, although not restrictive, example containing four radial tongues.

DETAILED DESCRIPTION OF THE PREFERRED EMBODIMENTS

Figure 1:
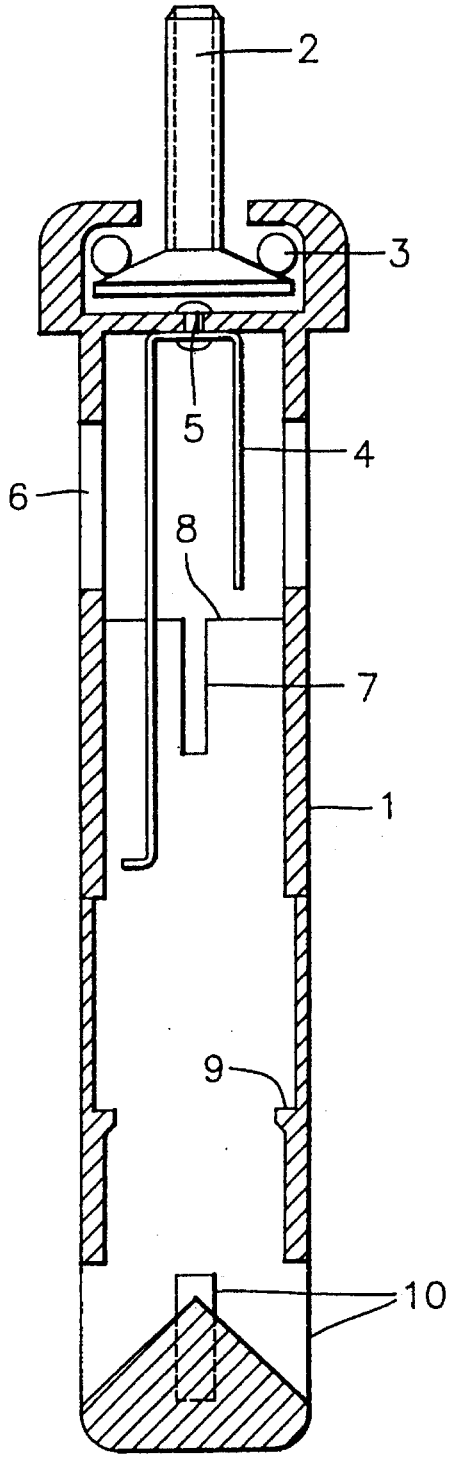
FIG. 1 represents a longitudinal section view of a body of the device.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

According to FIG. 1, the cylindric body 1 comprises, at its upper port, a screwed peg 2, rotatively mounted through the use of a bearing 3, a lamellar spring 4, which is attached to the upper port through rivet 5, windows 6, and a vertical groove 7 located on surface 8.

At the bottom or lower end of the body 1, there are four internal rabbets 9 and four openings 10. They are equally spaced for the retraction and expansion of four tongues 11 (shown in FIGS. 3 through 6).

Figure 2:
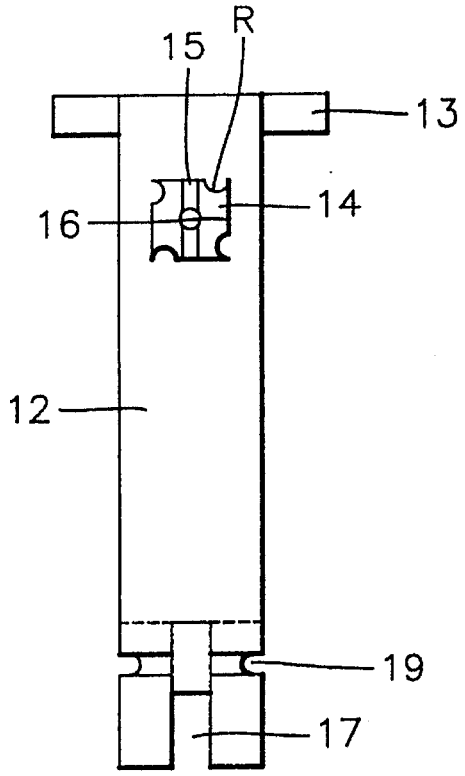
FIG. 2 represents a front view of the activator of the tongues.

The activator 12 of tongues 11, shown in FIG. 2, which is slidably mounted within body 1, comprises a cylindric tube containing upper rims 13, a rotating quadrangular selector 14, containing a longitudinal salience or projection 15, attached to activator 12 by means of peg or rivet 16. At the bottom end of activator 12, there are four grooves 17, equally spaced, for housing of the four tongues 11, which are kept in their correct position by means of a ring-shaped spring 18 (shown in FIGS. 3 through 6), mounted on a cylindric indentation 19.

Figure 3:
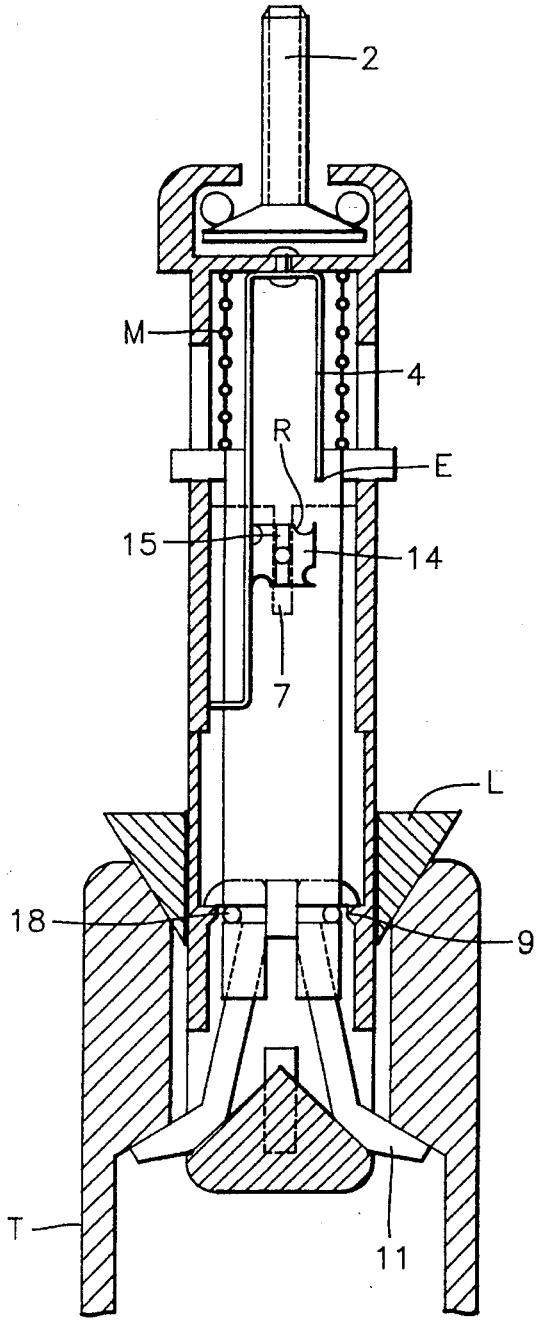
FIG. 3 is a longitudinal section view of the device attached to a tube.

The operation of the device will be described referring to FIGS. 3 through 6. FIG. 3 illustrates the device which is attached, on its bottom part, to a tube T and, on its upper part, to a spinning machine (not shown) by means of a peg 2.

In the position shown in FIG. 3, the tube T has the support of tongues 11, which, supported by rabbets 9, prevent descending movement, and selector 14 has its longitudinal salience or projection 15 in a vertical position in groove 7.

Figure 4:
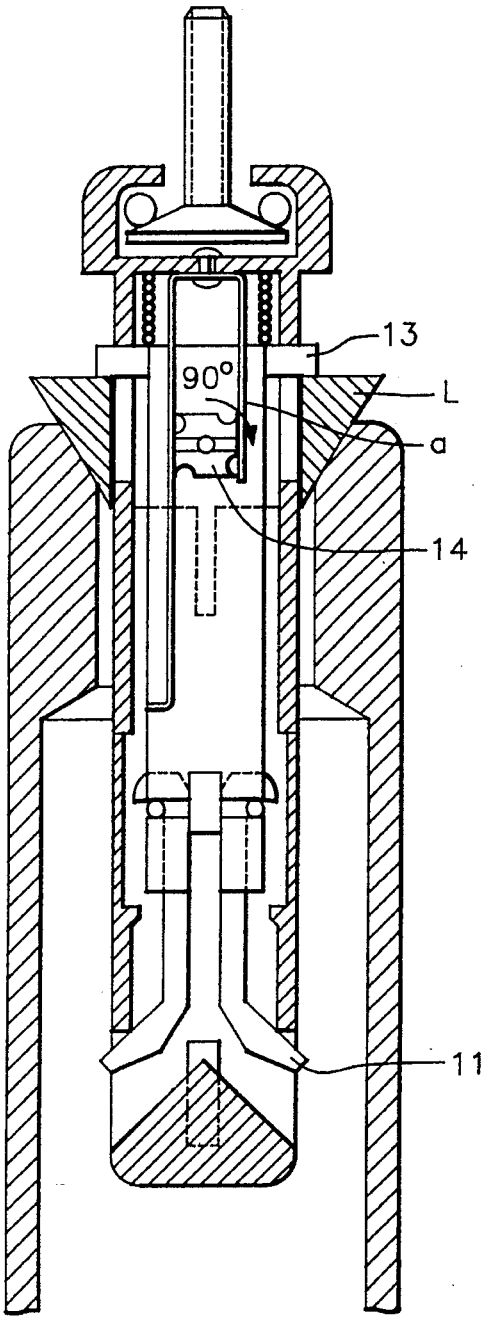
FIG. 4 is a longitudinal section view of the device in the uncoupling position.

Once the fiber strands are unrolled from the tube T, the tube must be removed from the device and replaced by another tube. For that, the operator pushes the tube T upwards against the cylindric spring M located between the upper part of the body 1 and the rims 13, as shown in FIGS. 3 and 4, moving the glove L, which produces upward movement of the activator 12, by movement of the upper rims 13 engaged by the glove L, and the consequent retraction of the tongues 11.

Simultaneously, selector 14 is rotated 90° clockwise, due to the contact of the spring 4 at the free end E with a depression R present in the upper corner of selector 14.

Figure 5:
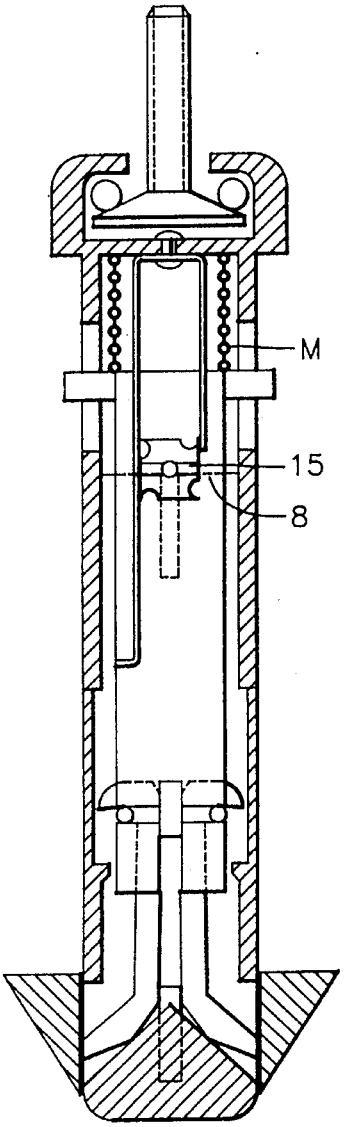
FIG. 5 is a longitudinal section view of the uncoupled device.
Figure 6:
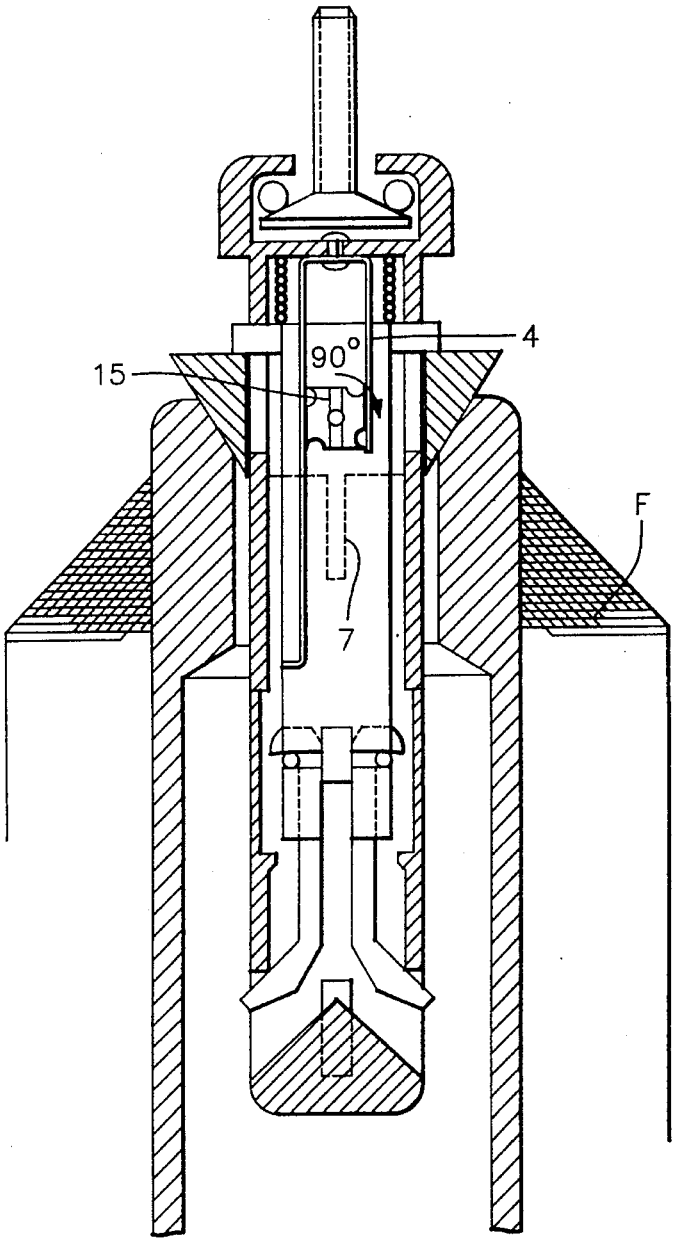
FIG. 6 is a longitudinal section view of the device in the coupling position.

After being taken out of the tube T, the activator 12 is pushed down by spring M, as shown in FIG. 5. The tongues 11 remain retracted in the openings 10, due to the horizontal contact of the salience or projection 15 with surface 8 of body 1 at the top of groove 7.

To mount a tube with fiber strands F to be unrolled (FIG. 6) onto the device, the operator introduces the internal diameter of the tube into the activator 12 (which has the tongues 11 retracted), thus moving the glove L and pushing the activator 12 upwards through engagement of the upper rims 13 with the glove L.

Simultaneously, the selector 14 is rotated 90° clockwise by spring 4 to position the salience or projection 15 vertically and to allow for the movement of the groove 7 up to the position shown in FIG. 3, in which the tongues 11 are caused to expand and attach to the interior wall of the tube T.

From the description above, it is important to notice that the device, which is the object of the current invention, allows for high stability attachment, and, at the same time, is easy to do.

Those who understand the technique must understand that, because the invention above is described according to one possibility, which is not an exclusive one, other modifications may be introduced to it without abandoning the scope of the annexed claims.

Having described the invention, many modifications thereto will become apparent to those skilled in the art to which it pertains without deviation from the spirit of the invention as defined by the scope of the appended claims.

I claim:

1. A coupling and support device for a tube, said coupling and support device comprising:

a cylindric body (1);

a peg (2) rotatably mounted on an upper part of said cylindric body by a bearing (3);

a lamellar spring (4) attached by a rivet (5) to said upper part of said cylindric body;

windows (6) and a vertical groove (7) located on a surface (8) of a lower end of said body (1); at least four tongues for supporting the tube;

at least four internal rabbets (9) and at least four openings (10) at said lower end of said body, equally spaced, for retraction and expansion of said at least four tongues (11) from said lower end of said body; and an activator (12) slidably mounted in an interior of said body (1) and having upper rims (13), a rotating selector (14) with a longitudinal projection (15) which is attached to said activator (12) by a peg (16), at a lower end of said activator (12), where there are at least four grooves (17), equally spaced, for housing of said at least four tongues (11), kept in a position by a ring-shaped spring (18) mounted in a cylindric depression (19).

2. A coupling and support device for a tube according to claim 1, wherein said at least four tongues (11) retract when said rotating selector (14) has said longitudinal projection (15) supported on said surface (8) of said cylindric body (1).

3. A coupling and support device for a tube according to claim 1, wherein said at least four tongues (11) expand when said rotating selector (14) has said longitudinal projection (15) sliding downwards on said vertical groove (7) of said cylindric body (1).

* * * * *